US006781050B2

(12) United States Patent
Olvera et al.

(10) Patent No.: US 6,781,050 B2
(45) Date of Patent: Aug. 24, 2004

(54) ELECTRIC GUITAR CIRCUIT CONTROL AND SWITCHING MODULE

(76) Inventors: John Charles Olvera, 2678 Starnes Rd., Edgemoor, SC (US) 29712; Gordon Alan Olvera, 1 Bear Meadow, Beyton, Suffolk (GB), 1P30 9HS ( * ) Notice: Subject to any disclaimer, the term of this patent is extended or adjusted under 35 U.S.C. 154(b) by 0 days.

(21) Appl. No.: 10/314,044

(22) Filed: Dec. 9, 2002

(65) Prior Publication Data

US 2004/0107822 A1 Jun. 10, 2004

(51) Int. Cl.[7] ..... G10H 1/32; G10H 3/00

(52) U.S. Cl. ..... 84/743; 84/745; 84/453

(58) Field of Search ..... 84/726–727, 743, 84/745, 453

(56) References Cited

U.S. PATENT DOCUMENTS 5,637,823 A * 6/1997 Dodge ..... 84/743

* cited by examiner

*Primary Examiner*—Marlon Fletcher
(74) *Attorney, Agent, or Firm*—Harleston Law Firm LLC; Kathleen M. Harleston

(57) ABSTRACT

An interchangeable passive electric guitar circuit control and switching module is integrated into an existing guitar to dynamically alter the electronic relationship of the guitar's electric components (i.e. the existing pickups, volume and tone controls, at least one tonality select switch, and output jack) which are connected to the module through a wiring harness. Individual interchangeable modules connected through the wiring harness establish finite and discrete electronic relationships through the guitar's existing electric components to produce a plurality of selectable desired tonality sounds from a single guitar.

18 Claims, 13 Drawing Sheets

Guitar – Front View

Guitar – Rear View

Guitar – Front View

Guitar – Rear View

Fig. 4

Wiring Harness Connections
(from Connector 50 to Volume and Tone Controls 42, 44, 46, Selector Switch 48, Pickups 22, 24, 26, and Output Jack 17)

| CONNECTOR 50 | CONNECTED TO: | CONNECTOR 50 | CONNECTED TO: |
|---|---|---|---|
| Pin 1 | 42a | Pin 14 | 48e |
| Pin 2 | 42b | Pin 15 | 48f |
| Pin 3 | 42c | Pin 16 | 48g |
| Pin 4 | 44a | Pin 17 | 48h |
| Pin 5 | 44b | Pin 18 | 22a |
| Pin 6 | 44c | Pin 19 | 22b |
| Pin 7 | 46a | Pin 20 | 24a |
| Pin 8 | 46b | Pin 21 | 24b |
| Pin 9 | 46c | Pin 22 | 26a |
| Pin 10 | 48a | Pin 23 | 26b |
| Pin 11 | 48b | Pin 24 | 17a |
| Pin 12 | 48c | Pin 25 | 17b |
| Pin 13 | 48d | | |

Module 60 - Wiring

Fig. 6

Module 60 - Circuit Relationships

| CONNECTOR 60 | CONNECTED TO 60 | CONNECTOR 60 | CONNECTED TO 60 |
|---|---|---|---|
| Pin 1 | Pins 13, 14 | Pin 14 | Pins 1, 13 |
| Pin 2 | Pin 24 | Pin 15 | Not Used |
| Pin 3 | Pins 19, 21, 25, | Pin 16 | Pin 9 |
| Pin 4 | Not Used | Pin 17 | Pin 5 |
| Pin 5 | Pin 17 | Pin 18 | Pin 12 |
| Pin 6 | Pin 8 | Pin 19 | Pin 25 |
| Pin 7 | Not Used | Pin 20 | Pin 11 |
| Pin 8 | Pin 6, 62a | Pin 21 | Pin 25 |
| Pin 9 | Pin 16 | Pin 22 | Pin 10 |
| Pin 10 | Pin 22 | Pin 23 | Pin 25 |
| Pin 11 | Pin 20 | Pin 24 | Pin 2 |
| Pin 12 | Pin 18 | Pin 25 | Pins 3, 19, 21, 23, Node 62b |
| Pin 13 | Pins 1, 14 | | |

Fig. 7

Module 60 – Component Combinations

| First Alternate Module 60 | | | | | |
|---|---|---|---|---|---|
| 5 | 4 | 3 | 2 | 1 | ← 5 WAY SWITCH POSITION VOLUME 1 |
| T1 | T1 | T1 | T1 | T1 | ← MASTER TONE CONTROL |
| ▬ | ▬ | ▬ | ▬ | ▭ | ← NECK PICKUP |
| ▬ | ▭ | ▬ | ▭ | ▬ | ← MIDDLE PICKUP VOLUME 2 |
| ▭ | ▬ | ▬ | ▬ | ▬ | ← BRIDGE PICKUP |
| ▬ | ← PICKUP IS ON | | | ▭ | ← PICKUP IS OFF |

Module 70 - Wiring

Fig. 9

Module 70 - Circuit Relationships

| CONNECTOR 70 | CONNECTED TO 70 | CONNECTOR 70 | CONNECTED TO 70 |
|---|---|---|---|
| Pin 1 | Pins 13, 14 | Pin 14 | Pins 1, 13 |
| Pin 2 | Pin 24 | Pin 15 | Pins 16, 9 |
| Pin 3 | Pin 25 | Pin 16 | Pins 9, 15 |
| Pin 4 | Not Used | Pin 17 | Pin 5 |
| Pin 5 | Pin 17 | Pin 18 | Pin 12 |
| Pin 6 | Pin 8 | Pin 19 | Pin 25 |
| Pin 7 | Not Used | Pin 20 | Pin 11 |
| Pin 8 | Pin 6, 62a | Pin 21 | Pin 25 |
| Pin 9 | Pins 15, 16 | Pin 22 | Pin 10 |
| Pin 10 | Pin 22 | Pin 23 | Pin 25 |
| Pin 11 | Pin 20 | Pin 24 | Pin 2 |
| Pin 12 | Pin 18 | Pin 25 | Pins 3, 19, 21, 23, Node 62b |
| Pin 13 | Pins 1, 14 | | |

Fig. 10

Module 70 – Component Combinations

| Second Alternate Module 70 | | | | | |
|---|---|---|---|---|---|
| 5 | 4 | 3 | 2 | 1 | ← 5 WAY SWITCH POSITION |
| T1 | T1 & T2 | T2 | T2 | NT | ← TONE CONTROL |
| ▬ | ▬ | ▭ | ▭ | ▭ | ← NECK PICKUP |
| ▭ | ▬ | ▬ | ▬ | ▭ | ← MIDDLE PICKUP |
| ▭ | ▭ | ▭ | ▬ | ▬ | ← BRIDGE PICKUP |
| ▬ | ← PICKUP IS ON | | | ▭ | ← PICKUP IS OFF |

Module 80 – Wiring

Fig. 12

Module 80 –Circuit Relationships

| CONNECTOR 80 | CONNECTED TO 80 | CONNECTOR 80 | CONNECTED TO 80 |
|---|---|---|---|
| Pin 1 | Pins 4, 9, 24 | Pin 14 | Pins 2, 13 |
| Pin 2 | Pins 13, 14 | Pin 15 | Not Used |
| Pin 3 | Pin 25 | Pin 16 | Pins 17, 18 |
| Pin 4 | Pins 1, 9, 24 | Pin 17 | Pins 16, 18 |
| Pin 5 | Pins 16, 17, 18 | Pin 18 | Pins 16, 17 |
| Pin 6 | Pin 25 | Pin 19 | Pin 25 |
| Pin 7 | Not Used | Pin 20 | Pin 5 |
| Pin 8 | Node 62a | Pin 21 | Pin 25 |
| Pin 9 | Pins 1, 4, 24 | Pin 22 | Pin 10, 11 |
| Pin 10 | Pin 11, 22 | Pin 23 | Pin 25 |
| Pin 11 | Pin 10, 22 | Pin 24 | Pin 1, 4, 9 |
| Pin 12 | Not Used | Pin 25 | 3, 6, 19, 21, 23, Node 62b |
| Pin 13 | Pins 2, 14 | | |

Fig. 13

Module 80 – Component Combinations

| Third Alternate Module 80 | | | | | |
|---|---|---|---|---|---|
| 5 | 4 | 3 | 2 | 1 | ← 5 WAY SWITCH POSITION VOLUME 1 |
| T1 | T1 | T1 | T1 | T1 | ← MASTER TONE CONTROL |
| ▬ | ▬ | ▬ | ▬ | ▭ | ← NECK PICKUP |
| ▬ | ▭ | ▬ | ▭ | ▬ | ← MIDDLE PICKUP VOLUME 2 |
| ▭ | ▬ | ▬ | ▬ | ▬ | ← BRIDGE PICKUP |
| ▬ | ← PICKUP IS ON | | | ▭ | ← PICKUP IS OFF |

ELECTRIC GUITAR CIRCUIT CONTROL AND SWITCHING MODULE

CROSS-REFERENCE TO RELATED APPLICATIONS

U.S. Patent Documents

| Patent # | Date | Inventor | U.S. Class |
|---|---|---|---|
| 6,121,537 | 19 Sep. 2000 | Pawar, et al | 84/728 |
| 5,780,760 | 14 Jul. 1998 | Riboloff | 84/726 |
| 5,763,808 | 09 Jun. 1998 | Thomson | 84/728 |
| 4,711,149 | 08 Dec. 1987 | Starr | 84/742 |
| 6,253,654 | 03 Jul. 2001 | Mercurio | 84/267 |
| 5,136,918 | 11 Aug. 1992 | Riboloff | 84/723 |
| 4,854,210 | 08 Aug. 1989 | Palozzolo | 84/726 |
| 4,872,386 | 10 Oct. 1989 | Betticare | 84/726 |
| 6,271,457 | 7 Aug. 2001 | Hudak | 84/731 |
| 6,316,713 | 13 Nov. 2001 | Furst, et al | 84/726 |
| 5,311,806 | 17 May. 1994 | Riboloff | 84/728 |
| 5,136,919 | 11 Aug. 1992 | Wolstein | 84/742 |

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

1. Field of the Invention

The invention relates generally to variable tone electric guitars and, more particularly, but not by way of limitation, it relates to an improved wiring/circuitry system for interchanging the selection and combination of pickup outputs, volume and tone controls, and tonality select switch(s) to provide a wide variety of output sounds.

2. Description of Related Art

This invention relates broadly to electrical musical instruments of the string type and more particularly to an improved wiring apparatus for the provision of a variable tone electric guitar. It is typically applicable to an electrical guitar or similar musical instrument having a plurality of stretched strings extending across a body and a neck, between the head of the instrument and a bridge assembly connected to the body, in which the strings are caused to vibrate by plucking or picking same. However, the invention is capable of broader application and can be used in any musical or other instrument that uses magnetic coupling means of disposed adjacent vibrating string members to generate energy or music. It is directed toward the art of electric guitar circuit switching, more particularly, the invention to an electric guitar that enables quick changes of circuitry to establish different electrical relationships between one or more pickups, one or more volume and tone controls, and one or more switches through the present invention, the modular apparatus. Different tonal modes are selected by means of a modular wiring apparatus. In this way, the guitar is able to produce a variety of tonal characteristics that might otherwise be provided by using more than one guitar. The present invention provides a simple and intuitive modular circuitry system for generating and selecting multiple tonalities and tonal blends that are familiar to most musicians. It differs from previous related art by enabling an improved electronic circuitry relationship of the electric pickups, volume and tone controls, and switch(s) of a stock instrument connected through a passive modular wiring apparatus that determines which combinations of pickups, volume and tone controls, and switches on the guitar are connected at any one time.

Historically, many musicians desired to play guitars that generated tonalities beyond the limit of a single guitar. While previous related art allowed altering tonality of an instrument, they generally relied on hardwire modifications of a specific component that limited the capability to dynamically alter tonal characteristics. Musicians rejected guitars that produced entirely new tones and those that introduced active electronics, new and different knobs or buttons, and multiple hard-to-use switches. Male modules of the present apparatus may be quickly interchanged to allow a dynamic and unlimited combination of electronic profiles through various male modules of the apparatus without altering the external appearance or feel of the stock instrument. It does not change the outward appearance of the instrument nor the number or positioning of the pickups, volume and tone controls, and switch(s) of the stock instrument. Thus, the musician maintains his familiarity with the layout and operation of the pickups, volume and tone controls, and switch(s). Additionally, the modular apparatus is configured to complete a specified and finite set of selection variables that enables a plurality of popular and well recognized tonalities and tone blends, to be played on a single guitar selectively using simple switches, volume and tone controls, and pickup units disposed on the guitar body at well known locations that are familiar to electric guitarists. Unplugging the modular apparatus and replacing it with another wired to provide a different circuitry relationship yields another set of specified and finite set of selection variables that enable a different plurality of tones using the same pickups, and/or volume and tone controls, and/or switch(s) that are familiar to electric guitarists. The modular apparatus permits changing of circuits within minutes and in some cases, seconds, rather than hours previously required to disassemble, rewire, test, and reassemble the instrument. Accordingly, the present invention provides a new and improved approach to electric guitar circuitry design, wiring, and installation that overcomes the above-referenced problems. The compact size of the interchangeable male module allows an individual access to various multiple wiring circuit profiles contained within specific models of the male module and is limited only by the models and number of male modules the artist possesses. Should other tonalities be desired, the individual need only insert a different module rather than purchase a new instrument.

PREVIOUS RELATED ART REFERENCED

The present invention exceeds the capabilities of the referenced patents of previous related art. Each is described as to the capability with a statement as to how the present invention surpasses the described capability.

Pawar, et al, U.S. Pat. No. 6,121,537 produced a fixed wiring system to select a plurality of Gibson and Fender tonalities on a single guitar. In addition to the fixed wiring system, Pawar included a set of multiple and complicated switches to achieve the desired plurality of sounds. The present invention enables a wider plurality of tonalities through interchangeable wiring circuitry profiles resident on the male module of the apparatus without altering the guitar's existing pickups, volume and tone controls, switch(s), and output jack.

Riboloff, U.S. Pat. No. 5,780,760 developed a guitar pickup switching system for a three-pickup guitar to allow the artist to select outputs of the pickups in any one of seven combinations. Two volume controls enable the artist to vary the blend of the treble pickup output and middle and rhythm pickup outputs from the switching system. Although this invention improves on the tonality provided from a single guitar, it modifies the visible appearance of the stock guitar and is limited in the tonalities provided. The present invention enables a wider plurality of tonalities through interchangeable wiring circuitry profiles resident on the male module of the apparatus without altering the guitar's existing pickups, volume and tone controls, switches, and output jack.

Thomson, U.S. Pat. No. 5,763,808 developed a switching apparatus for electric guitar pickup coils having dual coil bridge humbucker pickups, dual coil fingerboard humbucker pickups and a single coil intermediate pickup. The apparatus comprised a four-gang three-way switch and a two-gang five-way switch interconnect so that the guitarist may control which combination of pickups operate at any one time thereby providing the tonal characteristics of a STRATOCASTER, a LES PAUL, or a "coil tapped" LES PAUL guitar optional "out of phase" tonalities. Although this invention improves on the tonality provided from a single guitar, it modifies the visible appearance of the stock guitar and is limited in the tonalities provided. The present invention enables a wider plurality of tonalities through interchangeable wiring circuitry profiles resident on the male module of the apparatus without altering the guitar's existing pickups, volume and tone controls, switches, and output jack.

Starr, U.S. Pat. No. 4,711,149 developed an apparatus for facilitating an electrically quiet, one touch electrical switching in and out of the guitar output circuit selected combinations of the at least two pickups electrically switched out of the guitar output circuit, comprising (1) a plurality of discrete switches; (2) an encoding means interconnected to each of the discrete switches for sensing which of the plurality of switches had been depressed thus creating a plurality of distinct control signals, one distinct control for each of the discrete switch depressed; and (3) a plurality of automatic switch means interconnected to the encoding means and interconnected between one of the at least two pickups and guitar output circuit. Although this invention improves on the tonality provided from a single guitar, it modifies the visible appearance of the stock guitar, requires a battery, and is limited in the tonalities provided. The present invention enables a wider plurality of tonalities through interchangeable wiring circuitry profiles resident on the male module of the apparatus without altering the guitar's existing pickups, volume and tone controls, switches, and output jack and because it is a passive system, requires no battery.

Mercurio, U.S. Pat. No. 6,253,654 developed an electric stringed instrument with interchangeable pickup assemblies, which connect to electronic components fixed within the guitar body. This invention required extensive modification to the electric guitar, 'featuring a body having a rectangular shaped, through-the-body cutout between the neck and bridge, and having a connector in a portion of the cutout.' Although this invention approaches a modular capability, it is limited to pickup capability and requires extensive guitar modifications. The present invention enables a wider plurality of tonalities through interchangeable wiring circuitry profiles resident on the male module of the apparatus without altering the guitar's existing pickups, volume and tone controls, switches, and output jack.

Riboloff, U.S. Pat. No. 5,136,918 developed a switching system for an electric guitar using a bridge and fingerboard humbucker pickups and a single coil intermediate pickup wherein distinct groups of Gibson tonality and Fender tonality can be readily selected. The system used a two-gang, five-position switch for tone selection, the switch employing two double contacting wipers; and, for mode selection either a toggle or push-pull double pole, double-throw switch was utilized. Although this invention improves on the tonality provided from a single guitar, it modifies the visible appearance of the stock guitar and is limited in the tonalities provided. The present invention enables a wider plurality of tonalities through interchangeable wiring circuitry profiles resident on the male module of the apparatus without altering the guitar's existing pickups, volume and tone controls, switches, and output jack.

Palazzolo, U.S. Pat. No. 4,854,210 describes a detachable electric guitar pickup system that modularizes differing arrays of pickups to allow a plurality of sound. Although this increases the plurality of tones provided to a single guitar, it is limited to the current wiring system resident on the guitar. The present invention enables a wider plurality of tonalities through interchangeable wiring circuitry profiles resident on the male module of the apparatus without altering the guitar's existing pickups, volume and tone controls, switches, and output jack.

Betticare, U.S. Pat. No. 4,872,386 developed an interchangeable pickup system for an electric guitar similarly to Palazzolo; however, the interchangeable pickup system required machining to the existing guitar and was limited to the existing wiring on the guitar. Additionally, manufacturers added multiple knobs, buttons, and other electronic hardware to enable auxiliary coils to be connected in various combinations. The present invention enables a wider plurality of tonalities through interchangeable wiring circuitry profiles resident on the male module of the apparatus without altering the guitar's existing pickups, volume and tone controls, switches, and output jack.

Hudak, U.S. Pat. No. 6,271,457 developed a bridge-type piezoelectric pickup for guitars and other stringed instruments that had a flexible circuit board carrying a pair of transversely polarized piezoelectric crystals for each string, the two crystals of each string being closely spaced from one another along the length of the string and supporting a common saddle resting on both of the crystals and supportingly engaging the associated string. Although this invention improves on the tonality provided from a single guitar, it is limited in the range of tonalities provided. The present invention enables a wider plurality of tonalities through interchangeable wiring circuitry profiles resident on the male module of the apparatus without altering the guitar's existing pickups, volume and tone controls, switches, and output jack.

Furst, et al, U.S. Pat. No. 6,316,713, similarly to Riboloff, U.S. Pat. No. 5,780,760 developed a sound pickup switching apparatus for a stringed instrument having a plurality of sound pickups for an electric guitar. The apparatus included an operable switching device intended to connect the coils of the sound pickups in different combinations in order to produce an output signal of different tonality. Although this invention improves on the tonality provided from a single guitar, it modifies the visible appearance of the stock guitar and is limited in the tonalities provided. The present invention enables a wider plurality of tonalities through interchangeable wiring circuitry profiles resident on the male module of the apparatus without altering the guitar's existing pickups, volume and tone controls, switches, and output jack.

Riboloff, U.S. Pat. No. 5,311,806 developed a switching system for an electric guitar using bridge and fingerboard humbucker pickups and an intermediate pickup that provided for a ready selection of distinct groups of Gibson tonalities and Fender tonalities. A four pole, five-position switch for tone selection provided one-of-ten tonality selection in conjunction with a dual pole, double throw switch. Although this invention improves on the tonality provided from a single guitar, it modifies the visible appearance of the stock guitar and is limited in the tonalities provided. The present invention enables a wider plurality of tonalities through interchangeable wiring circuitry profiles resident on the male module of the apparatus without altering the guitar's existing pickups, volume and tone controls, switches, and output jack.

Wolstein, U.S. Pat. No. 5,136,919 developed a stringed instrument pickup and active switching circuitry that provided improvements in pickup sound combinations, hum rejection and overall electronic function. The circuit employed plural pickups, a selected combination of which may be selected by a rotary switch. A latching device controlled by the switch outputs produced a combination of control outputs to energize selected different FET switching devices to enable pickup signal outputs. Combined pickup signal outputs were then mixed and buffer amplified in a final output stage. Although this invention improves on the tonality provided from a single guitar, it modifies the visible appearance of the stock guitar and is limited in the tonalities provided. The present invention enables a wider plurality of tonalities through interchangeable wiring circuitry profiles resident on the male module of the apparatus without altering the guitar's existing pickups, volume and tone controls, switches, and output jack.

BRIEF SUMMARY OF THE INVENTION

The subject invention provides a passive electric guitar switching circuit module to generate a plurality of selectable desired tonality sounds from a single guitar with an existing set of pickups, volume and tone controls. Changing the module allows for a different, yet finite, set of pickup selections and may assign different functions to the potentiometers as to either volume or tone control.

The module regulates three sections: pickups, volume and tone controls, and tonality select switch(s). The pickup system includes one or more pickups, and where more than one pickup is used, a tonality select switch is provided for connecting or selecting additional pickups in desired combinations, thereby selecting from a plurality of desired tonalities.

The control section, including two or more potentiometers, functions in combination to provide volume and tone control of the pickup system. Each lead from the pickup(s), tonality select switch(s), and volume and tone controls is singularly connected to a designated pin on the male connector (collectively—the wiring harness). The electric guitar circuit control and switching module is connected to the wiring harness via a male connector to provide the circuitry relationships of the pickup(s), volume and tone controls, the tonality select switch(s) and required resistors and capacitors. The musician can selectively employ any of several interchangeable modules, each small, light, inexpensive, and easily transported. Each electric guitar circuit control and switching module contains one circuit, provides a finite set of pickup selections, and, thereby, provides a set plurality of desired tonalities. Additionally, the module allows the musician to select the relationships of pickup(s) and control electronics by changing to different modules, each module providing a finite set of pickup(s) selections, and thereby providing a set plurality of desired tonalities. Thus, with a guitar according to the present invention, a player has unsurpassed flexibility of plurality of tonalities compared to the prior art.

The invention is especially well suited for use in electric guitars and will be described with particular reference thereto; however, the invention is capable of broader application and can be used in any musical or other instrument that uses magnetic coupling means of disposed adjacent vibrating string members to generate energy or music.

BRIEF DESCRIPTION OF THE SEVERAL VIEWS OF THE DRAWING

The invention may take physical form in certain parts and arrangement of parts. A preferred embodiment of which will be described in detail in this specification and illustrated in the accompanying drawings which form a part hereof, and wherein:

FIG. 4/13, Wiring Harness Connections, describes a three pickup system employing three potentiometers for volume and tone control, a tonality select switch and an output jack with their individually connected to individual and separate pins of the female connector and collectively these components comprising the wiring harness.

FIG. 6/13, Module 60—Circuit Relationships, illustrates the connections of the first alternate module that define variable circuit relationships between the volume and tone controls, selector switch, pickups, capacitor and output jack.

FIG. 7/13, Module 60—Component Combinations, illustrates the first alternate electric guitar circuit switching and control module and establishes the connections defining the variable relationships between the volume and tone controls, selector switch, pickups, capacitor, and output jack.

FIG. 9/13, Module 70—Circuit Relationships, illustrates the connections of the second alternate module that define variable circuit relationships between the volume and tone controls, selector switch, pickups, capacitor and output jack.

FIG. 10/13, Module 70—Component Combinations, illustrates the second alternate electric guitar circuit switching and control module and establishes the connections defining the variable relationships between the volume and tone controls, selector switch, pickups, capacitor, and output jack.

FIG. 12/13, Module 80, Circuit Relationships, illustrates the connections of the third alternate module that define variable circuit relationships between the volume and tone controls, selector switch, pickups, capacitor and output jack.

FIG. 13/13, Module 80—Component Combinations, illustrates the third alternate electric guitar circuit switching and control module and establishes the connections defining the variable relationships between the volume and tone controls, selector switch, pickups, capacitor, and output jack.

DETAILED DESCRIPTION OF THE INVENTION

Figure 1:
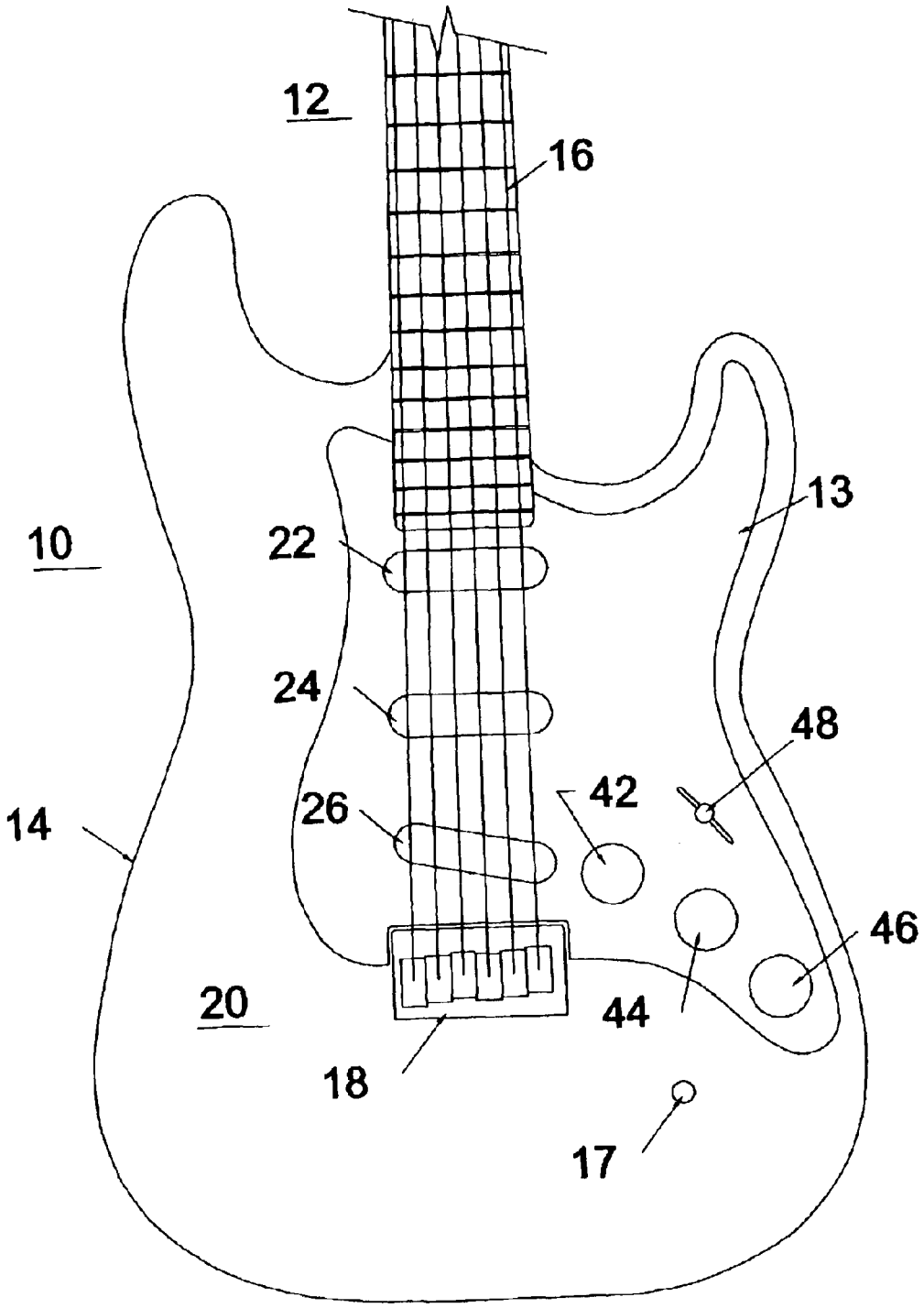
FIG. 1/13, Guitar—Front View, is a front view of the guitar body and illustrating a portion of a neck or fingerboard, showing the preferred layout of three pickup units, three volume and/or tone controls, and tonality select switch(s) of the pickup system of the present invention.

Referring now to the drawings wherein the showings are for the purposes of illustrating the preferred embodiment of the invention only and not for purposes of limiting same, FIG. 01/13 shows the guitar 10 provided and illustrating a portion of a neck or fingerboard 12, pickguard 13 secured to a main body 14. The guitar 10 includes guitar strings 16 that are secured on one end to a bridge 18 and, on the other end, to a tuning head (not shown) in a manner well known in the art. A traditional quarter-inch open circuit jack 17 is provided to interface the electric pickup coils within the guitar 10 to associated electrical equipment such as amplifiers and the like in a well known manner. In accordance with the present invention three pickup units 22, 24, and 26 are arrayed beneath the strings 16 and are secured onto the pickguard 13 or the face 20 of the main body 14 of the guitar in a conventional manner. The volume and tone controls 42, 44, and 46 and one five-position two-pole switch 48 look and feel like standard guitar controls that are familiar to musicians and, accordingly, present a non-intimidating interface for producing a plurality of desired tonalities at the output jack 17.

Figure 2:
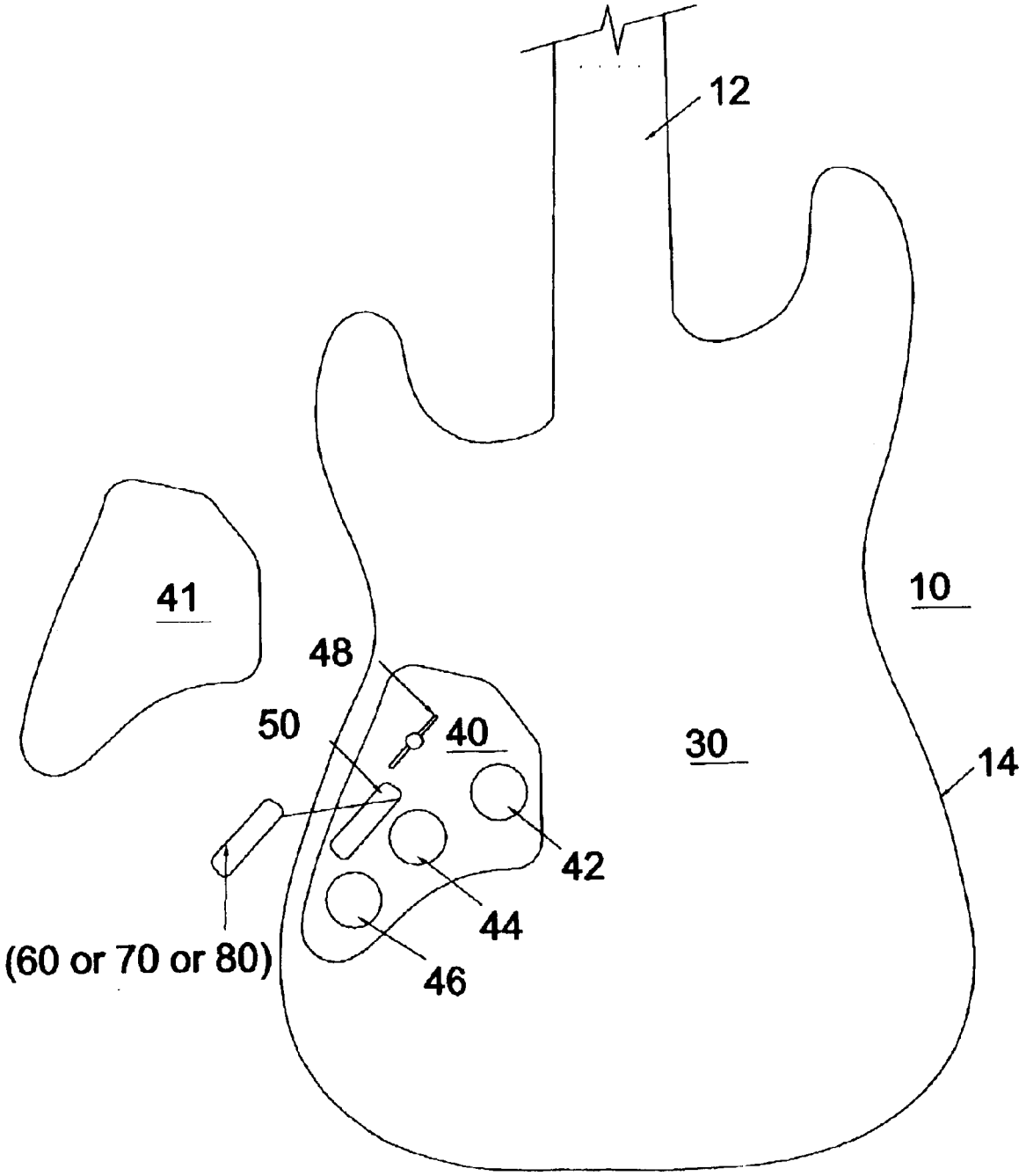
FIG. 2/13, Guitar—Rear View, depicts the rear surface of the guitar body and illustrating a portion of the neck or fingerboard secured to a main body, showing a notional rear access plate to the control cavity containing potentiometers, pickups, volume and/or tone controls, at least one the tonality select switch of the electric guitar circuit control and the female portion of the switching module of the apparatus.
Figure 11:
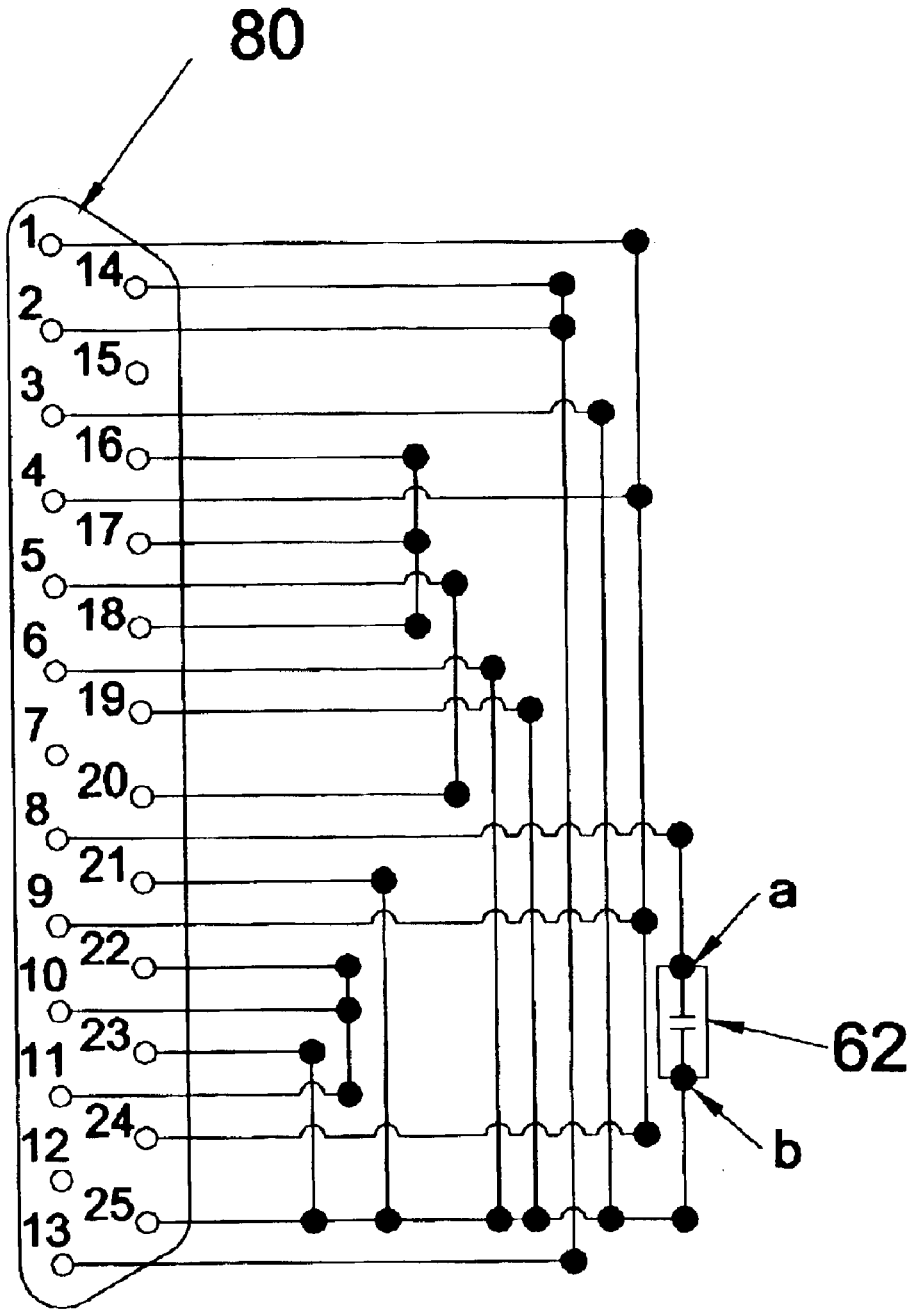
FIG. 11/13, Module 80—Wiring, is a schematic diagram of the preferred embodiment showing the electric guitar circuit control and switching module comprised of a corresponding male connector and the resident electronic circuitry contained and illustrates a third alternate modular circuit (Module 80) of the present invention.

Referring now to FIG. 02/13 wherein the showings are for the purposes of illustrating the preferred embodiment of the invention only and not for purposes of limiting same, depicting a rear surface 30 of guitar 10 and illustrating a portion of the neck or fingerboard 12 secured to a main body 14. The guitar 10 includes a rear access plate 41, a control cavity 40 containing three potentiometers 42, 44, and 46, one five-position two-pole switch 48, and the female receptacle 50 which receives the electric guitar switching circuit module 60 (FIG. 05/13) or 70 (FIG. 08/13) or 80 (FIG. 11/13).

Figure 3:
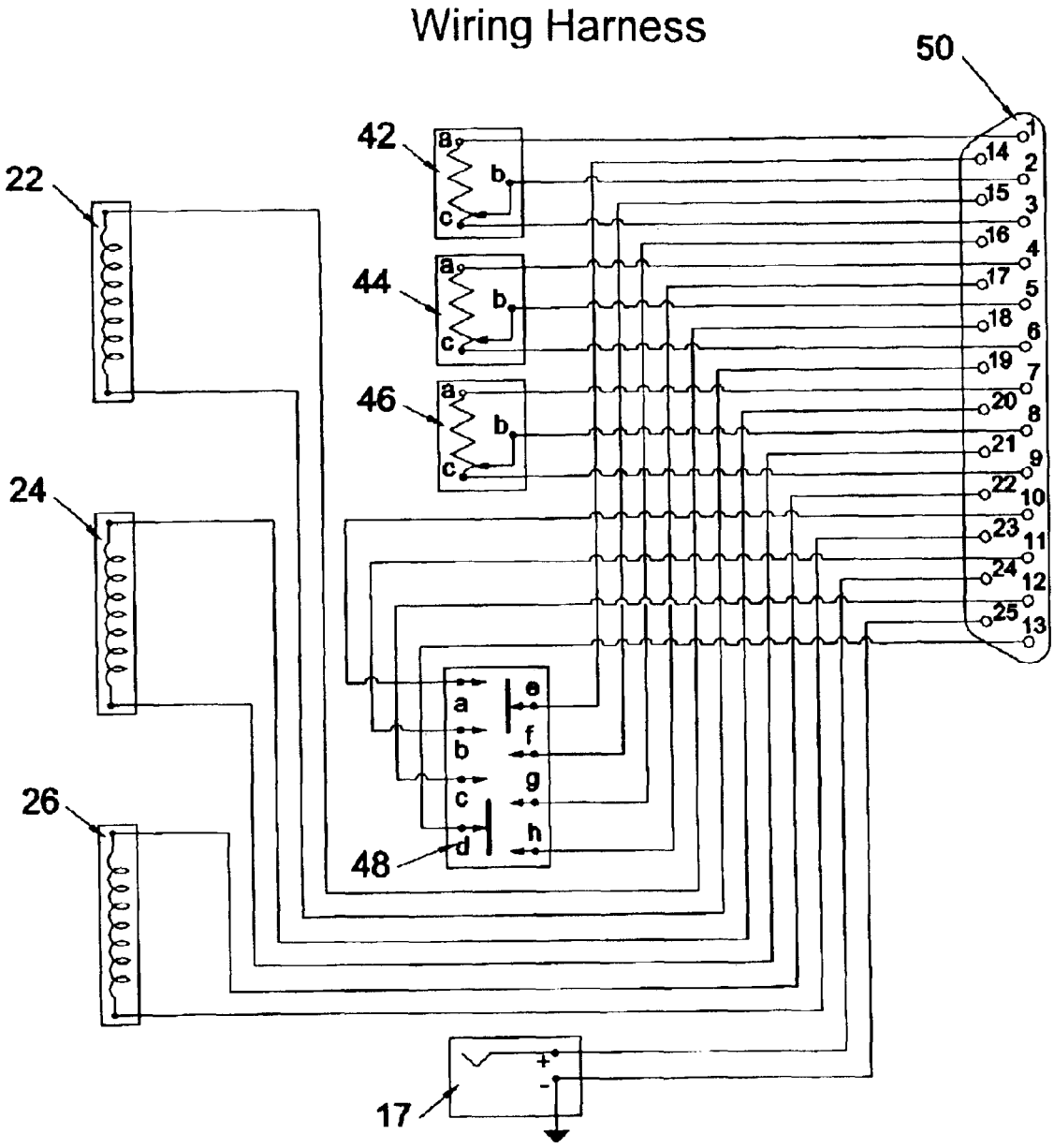
FIG. 3/13, Wiring Harness, is a drawing of the wiring harness developed to connect the electronic pickup configuration, volume and/or tone controls, and at least one the tonality select switch of the electric guitar circuit control to the apparatus.

Referring now to FIG. 03/13 wherein the showings are for the purposes of illustrating the preferred embodiment of the invention only and not for purposes of limiting same, in accordance with the present invention comprising three pickup units 22, 24, 26, volume and tone controls 42, 44, and 46, one five-position two-pole switch 48, and one output jack 17, are connected to individual and separate pins on and the female receptacle 50. These leads, collectively, comprise the wiring harness and are connected as set forth in FIG. 04/13.

Figure 5:
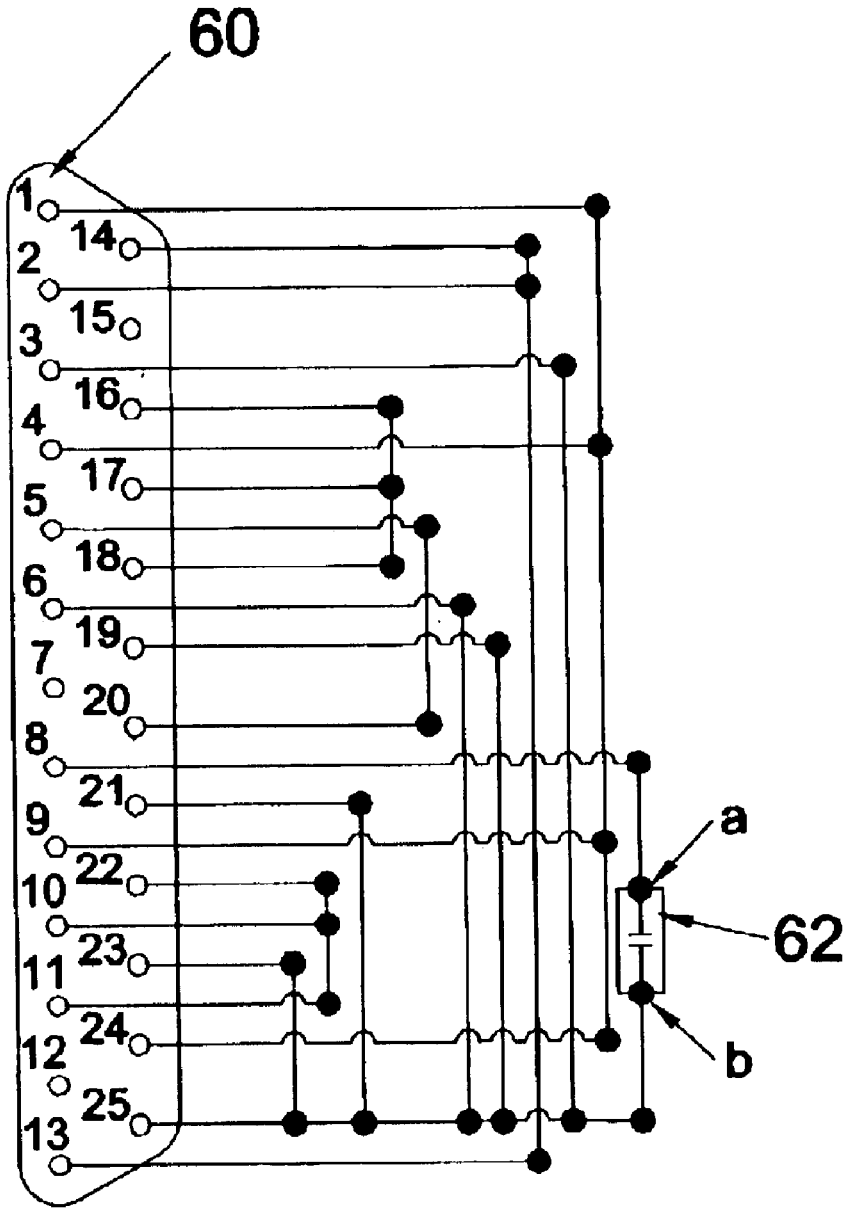
FIG. 5/13, Module 60—Wiring, is a schematic diagram of the preferred embodiment showing the electric guitar circuit control and switching module comprised of a corresponding male connector and the resident electronic circuitry contained and illustrates the first alternate modular circuit (Module 60) of the present invention.

The male module 60 schematically illustrated in FIG. 5/13 is connected to the female connector 50, FIG. 3/13 and as defined in FIG. 06/13, establishes the connections and defines the variable relationships between the volume and tone controls 42, 44, 46, selector switch 48, pickups 22, 24, 26, capacitor 62, and output jack 17 shown in FIG. 3/13. As defined in FIG. 06/13, the module 60 establishes an electronic circuit comprised of the volume and tone controls 42, 44, 46, selector switch 48, pickups 22, 24, 26, and output jack 17 and thereby establishes a first alternate module generating a set of pluralities of tonalities signals from said electric guitar.

As can be seen from the foregoing, the primary object of the invention is the provision of a simple passive electric guitar circuit control and switching module to enable generating and selecting from a plurality of desired tonality sounds. A further object of the invention is the provision of a modular system 60 of the general type described which is aesthetically pleasing and provides a component layout so that the guitar is readily familiar and therefore, easily useable by most musicians. A still further object is a provision of a tonality select switch 48 disposed on the body of the guitar 14 that enables the guitar to selectively produce a plurality of tonalities. This is accomplished through use at least one tonality select switch 48 and the relationships as established through the pin connections 60 and as defined in FIG. 06/13.

FIG. 07/13 illustrates the first alternate electric guitar circuit switching and control module 60 and graphically defines the variable relationships between the volume and tone controls 42, 44, 46, selector switch 48, pickups 22, 24, 26, capacitor 62, and output jack 17 established through the electronic circuitry contained within the module of the apparatus, FIG. 7/13, and the wiring harness, FIG. 3/13.

Figure 8:
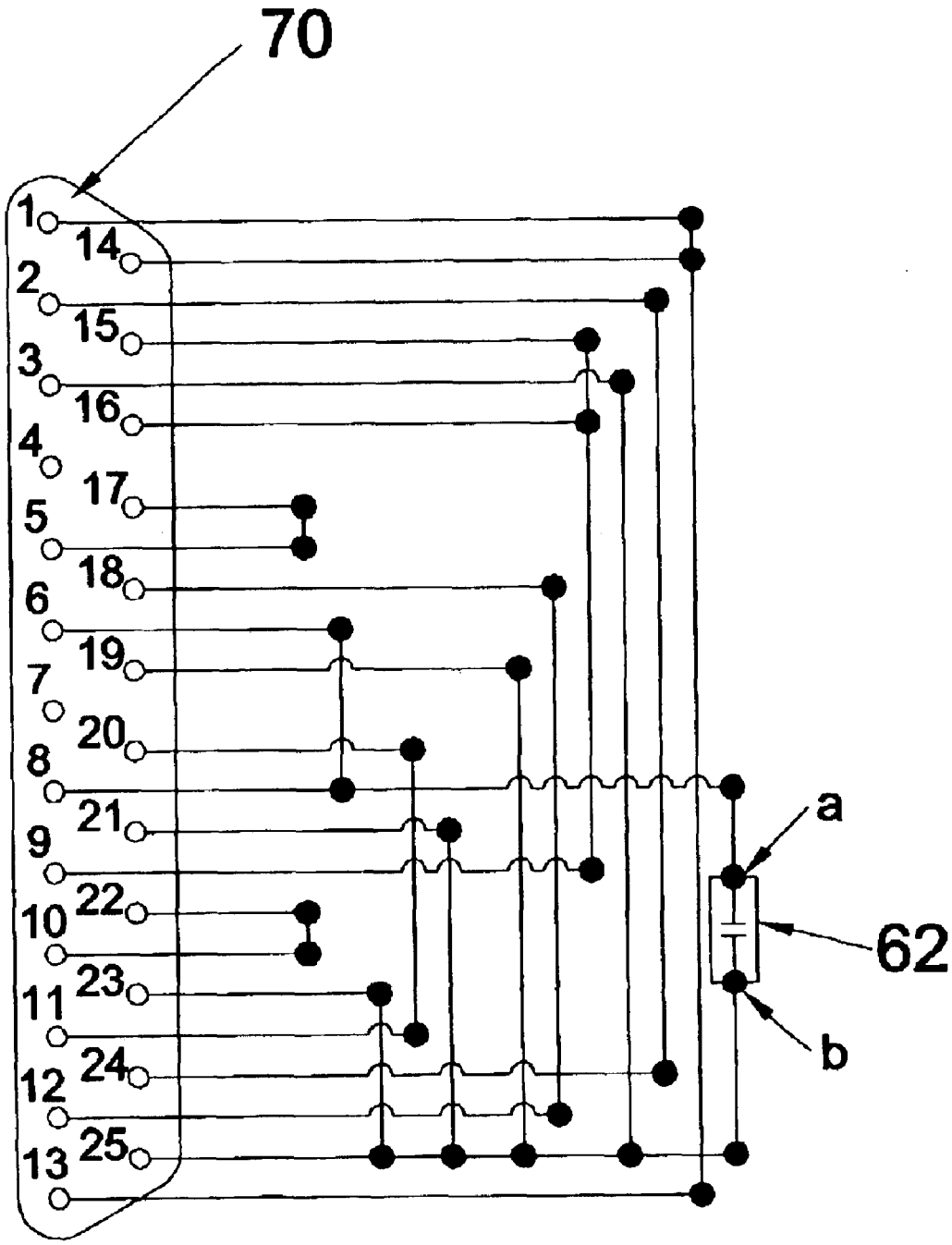
FIG. 8/13, Module 70—Wiring, is a schematic diagram of the preferred embodiment showing the electric guitar circuit control and switching module comprised of a corresponding male connector and the resident electronic circuitry contained and illustrates a second alternate modular circuit (Module 70) of the present invention.

Referring now to FIG. 08/13 wherein the showings are for the purposes of illustrating the preferred embodiment of the invention only and not for purposes of limiting same, The male module 70, schematically illustrated in FIG. 8/13, is connected to the female connector 50, FIG. 3/13 and establishes the connections and defines the variable relationships between the volume and tone controls 42, 44, 46, selector switch 48, pickups 22, 24, 26, capacitor 62, and output jack 17 shown in FIG. 3/13.

The male module 70 connected to female connector 50 and as shown in FIG. 09/13, establishes the connections and defines the variable relationships between the volume and tone controls 42, 44, 46, selector switch 48, pickups 22, 24, 26, and output jack 17 shown in FIG. 3/13. As defined in FIG. 09/13, the module 70 establishes an electronic circuit comprised of the volume and tone controls 42, 44, 46, selector switch 48, pickups 22, 24, 26, capacitor 62, and output jack 17 and thereby establishes a second alternate set of a plurality of tonality signals from said electric guitar.

FIG. 09/13 and FIG. 10/13 define a second alternate set of a plurality of tonalities provided through the interchangeable male module 70.

Referring now to FIG. 11/13 wherein the showings are for the purposes of illustrating the preferred embodiment of the invention only and not for purposes of limiting same, in accordance with the present invention comprising three pickup units 22, 24, 26, volume and tone controls 42, 44, and 46, one five-position two-pole switch 48, and one output jack 17, FIG. 3/13, are connected to individual and separate pins on and the female receptacle 50. These leads, collectively, comprise the wiring harness and are connected as set forth in FIG. 04/13.

The male module 80, shown schematically in FIG. 11/13 and as defined in FIG. 12/13, is connected to female connector 50, FIG. 3/13, and establishes the connections and defines the variable relationships between the volume and tone controls 42, 44, 46, selector switch 48, pickups 22, 24, 26, and output jack 17 shown in FIG. 3/13. As defined in FIG. 12/13, the module 80 establishes an electronic circuit comprised of the volume and tone controls 42, 44, 46, selector switch 48, pickups 22, 24, 26, capacitor 62, and output jack 17, FIG. 3/13, and thereby establishes a third set of a plurality of tonality signals from said electric guitar.

FIG. 12/13 and FIG. 13/13 define a third alternate set of a plurality of tonalities available through male module 80.

In summary the male module 60, 70, 80 is for use in a stringed electric instrument, preferably a electric guitar 10 that is unrestricted as to type or brand. Interchangeable modular switching circuitry and modular user-selected circuit profiles are located within the male module 60, 70, 80, such that the module augments the instrument's point-to-point wiring and provides the electrical circuitry for the pickups 22, 24, 26, volume and/or tone controls 42, 44, 46, and tonality select switch(es) 48, allowing selective connection with one or more pickup units, volume and/or tone controls 42, 44, 46, and tonality select switch(es) 48 of the guitar, thereby altering the tonal characteristics of the guitar through the proprietary circuitry profile of the user-selected modular apparatus. The electrical circuitry of the male module is also removably connectable with the output jack 17 and/or capacitor 62 of the electric guitar. The male module may comprise a capacitor.

The female module terminal assembly resides within the control captivity of the guitar body, and mates with the male module terminals residing in any one of three places; 1) within the control cavity of the instrument body; 2) as an external module residing on the instrument surface; or 3) within the instrument pickguard, accomplishing an electrical connection between the pickups 22, 24, 26 and the set of pickups, volume and/or tone controls 42, 44, 46, and tonality select switch(es) 48. The output jack 17 transmits an electrical signal to an external amplifier via a cable or electronic transmission.

The interchangeable male module 60, 70, 80 can be incorporated into almost any electric guitar and enables modular circuit profile interchangeability. The male module is removable and can be interchanged between different electric guitars, as desired.

The male module 60, 70, 80 can be disposed externally or within the recess(es) of the instrument. Suitable mounting means include a wiring harness with attached female conductive terminals. The female terminals selectively engage the corresponding conductive male module terminals upon engaging the module element in a predetermined position relative to the mounting.

The male module 60, 70, 80 includes operable switching means for selectively connecting coils of the sound pickups 22, 24, 26, volume and/or tone controls 42, 44, 46, and tonality select switch(s) 48 in different combinations in order to produce an output signal producing a desirable plurality of tonalities. Each different male module is capable of producing a different array of plural tonalities.

The male module 60, 70, 80 provides an electric guitar with the capability to emulate many different guitars and to rapidly change tonality profiles, thereby altering sonic profiles of the instrument within minutes and, in some cases, seconds, through interchangeable plug-in modules.

Once connected with the existing pickups 22, 24, 26, volume and/or tone controls 42, 44, 46, and tonality select switch(es) 48 of the electric guitar, the module 60, 70, 80 may, in some cases, require minimum and common hand-tools to exchange modules.

The electronic circuitry residing on the male module 60, 70, 80 is preferably encased in a suitable protective material, which may include the control cavity access plate or pickguard. This facilitates the rapid and easy interchange of the male modules.

The male module 60, 70, 80 further provides a plurality of sub-tonalities to be generated through simple and easy-to-use modular circuitry based upon the position of the tonality select switch(es) and the selected module without altering the existing layout of guitar pickups, volume and/or tone controls, and tonality select switch(es) or the external appearance of the guitar, Therefore, the electric guitar is readily familiar, aesthetically pleasing, and easily usable by most musicians. The module is insertable through a rear of the guitar. No structural modifications of the instrument's main body are required for installation of the male module 60, 70, 80, and the structural integrity of the instrument is maintained.

The invention has been described with reference to the preferred embodiments. Obviously modifications and alterations will occur to others upon a reading and understanding of the specification. It is intended to include all such modifications and alterations insofar as they come within the scope of the appended claims or the equivalence thereof. It shall be understood that we do not consider the invention to be limited to the precise details as shown and set forth in this specification, for obvious modifications will occur to those skilled in the art to which the invention pertains.

We claim:

1. An interchangeable male module for a electric stringed instrument, the male module being removably matable with a corresponding female receptacle within the instrument, the male module comprising electrical circuitry removably connectable to an existing at least one pickup unit, at least one volume or tone control, and at least one tonality select switch of the instrument; the electrical circuitry comprising switching circuitry and a circuitry profile for selectively connecting the at least one pickup unit, the at least one volume or tone control, and the at least one tonality select switch of the instrument, thereby altering tonal characteristics of the instrument; and wherein the male module does not itself comprise a pickup unit, volume or tone control, or tonality select switch.

2. The interchangeable male module set forth in claim 1, wherein the electric stringed musical instrument is an electric guitar, and the male module lies within a control cavity in a main body of the electric guitar or on a surface of the electric guitar.

3. The interchangeable male module set forth in claim 1, wherein the electric stringed musical instrument is an electric guitar, and the male module is within a pickguard of the electric guitar.

4. The interchangeable male module set forth in claim 1, further comprising a wiring harness connecting the at least one pickup unit, the at least one volume or tone control, and the at least one tonality select switch to a plurality of female conductive terminals; the male module comprising corresponding male conductive terminals for engaging the female conductive terminals.

5. The interchangeable male module set forth in claim 4, further comprising a switching means for selectively connecting the at least one pickup unit, volume and tone controls, and the at least one tonality select switch in different combinations to produce an output signal producing plurality of tonalities.

6. The interchangeable male module set forth in claim 1, wherein the electric stringed musical instrument is an electric guitar, and the module facilities rapid changes in tonality and sonic profiles.

7. The interchangeable male module set forth in claim 6, wherein connection and disconnection of the male module with the female receptacle require a minimum of hand-tools.

8. The interchangeable male module set forth in claim 2, wherein the circuitry is encased in protective material.

9. The interchangeable male module set forth in claim 8, wherein the at least one tonality select switch comprises a plurality of positions corresponding to a plurality of subtonalities.

10. The interchangeable male module set forth in claim 8, wherein the protective material comprises an access plate of the control cavity.

11. The interchangeable male module set forth in claim 3, wherein the electrical circuitry is encased in a protective material that comprises the pickguard.

12. The interchangeable male module set forth in claim 1, wherein the electrical circuitry of the male module is also removably connectable with an output jack of the instrument, but the male module does not itself comprise an output jack.

13. The interchangeable male module set forth in claim 12, further comprising a capacitor.

14. The interchangeable male module set forth in claim 4, wherein the wiring harness further connects an output jack of the instrument to the female conductive terminals.

15. The interchangeable male module set forth in claim 1, wherein no structural modification of a main body of the instrument is required.

16. The interchangeable male module set forth in claim 2, wherein the male module is insertable through a rear of the guitar, and structural integrity of the instrument is maintained.

17. The interchangeable male module set forth in claim 1, which does not require a battery.

18. The interchangeable male module set forth in claim 1, wherein a plurality of leads from the at least one pickup unit, the at least one volume or tone control, and the at least one tonality select switch are each connected to a pin on a corresponding female receptacle.

* * * * *